United States Patent [19]

Peterson

[11] 4,319,513

[45] Mar. 16, 1982

[54] ELECTRICALLY DRIVEN TREMOLO DEVICE

[76] Inventor: Richard H. Peterson, 11748 Walnut Ridge Rd., Palos Park, Ill. 60464

[21] Appl. No.: 190,000

[22] Filed: Sep. 23, 1980

[51] Int. Cl.[3] ..... G10B 3/18

[52] U.S. Cl. ..... 84/348

[58] Field of Search ..... 84/348, 374

[56] References Cited

U.S. PATENT DOCUMENTS

| | | | |
|---|---|---|---|
| 1,619,532 | 3/1927 | Nieman | 84/348 |
| 2,633,047 | 3/1953 | Glatter-Gotz | 84/348 |
| 3,018,682 | 1/1962 | Imhoff | 84/348 |

*Primary Examiner*—George H. Miller, Jr.
*Assistant Examiner*—Benjamin R. Fuller
*Attorney, Agent, or Firm*—Jones, Tullar & Cooper

[57] ABSTRACT

A motor driven tremolo generator adapted to be connected to the pressure regulating air reservoir for a pipe organ is disclosed. The tremolo generator consists of an elongated housing pivotally mounted at one end with a free end being adapted to produce a reciprocating motion for transmission to the pressure regulator. An electric drive motor is mounted at the first end of the housing near the pivot connection, and is connected to drive a rotatable shaft located at the second, or free end of the housing. An eccentrically mounted weight is carried by the shaft so that rotation of the drive motor causes the weight to cause the free end of the housing to oscillate with respect to the pivot point. At a point generally intermediate the pivotal connection and the location of the shaft carrying the concentric weight is a suitable linking mechanism which connects the housing to the center of the bellows, whereby the reciprocating motion of the housing is transmitted to the bellows. This superimposes on the bellows a periodic motion which produces a corresponding variation in the air pressure within the regulator and thereby produces a tremolo effect in the sound of the organ pipes.

15 Claims, 5 Drawing Figures

ELECTRICALLY DRIVEN TREMOLO DEVICE

BACKGROUND OF THE INVENTION

The present invention relates, in general, to tremolo devices for pipe organs, and more particularly to a motor driven tremolo arm which is pivotally mounted at one end and interconnected with the wind supply for the organ so that a reciprocating motion of the free end of the tremolo device produces a periodic pressure variation in the wind supply to produce the desired tremolo effect in the sound produced by the organ pipes.

It has long been known in the pipe organ art that tremolo effects can be produced in the speech of organ pipes by varying the pressure of the air supplied to those pipes. Such variations in air pressure cause corresponding variations in the amplitude and frequency of the sound produced by the pipes, with the sound from all of the pipes varying at the same time to produce a pleasing effect in the overall sound of the organ.

One of the early techniques utilized in the production of tremolo, and a technique that is still commonly in use, is the provision of a dump valve which periodically vents pressurized air from the air supply of the organ. Although such a dump valve can be located elsewhere in the air supply system, it is usually found in the air pressure regulator, either mounted directly on the regulator box, or connected thereto by a short conduit. The pressure regulator is a variable reservoir which receives air from a suitable source of supply, such as a large blower fan, and directs the air to the wind chest which directly supplies air to the pipes. The regulator includes a bellows arrangement which is biased in accordance with the pressure to be maintained. The bellows collapses as pipe stops are opened to draw air out of the wind chest to thereby maintain the desired air pressure, and expands when the pipe stops are closed. Although the bellows is in substantially constant motion during the playing of the organ, the air pressure within the system remains essentially constant so that the pipes will remain in tune.

The dump valve tremolo devices operate periodically to release air from the pressure regulator reservoir, thereby to superimpose on the air flow variation in pressure which are too rapid for compensation by the bellows and which thereby produce tremulant variations in the sound produced by the organ pipes. The dump valve is essentially a resonant device which, when activated, alternately opens and closes at a periodic rate which depends upon the design of the valve. Such devices are well known in the prior art, and are illustrated in patents such as U.S. Pat. No. 478,552 to Basset, No. 797,719 to Challinor, No. 1,243,644 to Van-Valkenbeurg, No. 1,262,640 to Cloetens, and No. 2,633,047 to Glatter-Gotz.

Although tremolo devices of the dump valve type have been used in the art for many years, they have not been entirely satisfactory, since they reduce the amount of air available to operate the pipes, and thus require a larger air supply than would normally be necessary. This increases the cost of the organ, requires additional space for installation, and increases the amount of noise produced by the air supply fan. Further, such tremolo devices often produce effects which change with the amount of air being delivered to the organ. Thus, a chord with a large number of notes played at one time may have a different tremolo than is produced when only one or two notes are played, and this may produce undesirable results. Furthermore, these devices are complex, and can easily get out of adjustment, as for example, with changes in ambient temperature.

A solution to many of the difficulties encountered with the dump valve arrangement was provided a number of years ago with the introduction of a motor-driven counterweight device mounted directly on the air regulator bellows. Operation of the motor and consequent rotation of the counterweight superimposed on the motion of the bellows an oscillatory motion which produced the desired periodic variation in air pressure to provide the tremolo effect, without the loss of air experienced with dump valves. Although this was in some ways an improvement over the dumping valve arrangement, it was not entirely satisfactory since the rotation of the counterweight introduced not only vertical motion in the bellows, but horizontal components as well, since it was not possible to direct the force produced by the device at the center of the bellows. It was found that this multidirectional vagrant motion of the bellows resulted in a very high rate of wear on the bellows itself, which usually is made of leather or similar flexible material. Furthermore, because of this vagrant motion of the bellows, this device was very inefficient, required a large heavy motor for operation, and did not produce a good tremolo effect.

Another difficulty with this direct-mounted motor driven tremolo device was that the motor and counterweight assembly added a considerable amount of weight to the bellows structure, thus changing the resonant frequency of the bellows and affecting the overall pressure of the system.

An attempt to solve the difficulties experienced with the foregoing arrangement is illustrated in U.S. Pat. No. 3,018,682 to Imhoff, which utilizes a motor-driven cam wheel to produce tremolo effects. The cam wheel is connected to the bellows of an air pressure regulator by means of a drive rod connected to one end of a lever arm which extends across the top of the bellows. The center of the lever arm is connected to the bellows and the free end carries a lead weight. Rotation of the cam wheel causes the drive rod to move vertically, and causes the lever arm to pivot around its midpoint connection to the bellows. The lead weight on the free end of the lever arm provides inertia in the lever arm which thereby causes the bellows to be vertically displaced by the rotation of the cam wheel, with the size of the lead weight determining the amplitude of this displacement.

Although the Imhoff device represented an improvement over the prior motor-driven tremolo device in that it reduced the amount of vagrant motion in the bellows, the Imhoff device may introduce other problems, for the numerous bearings required in the rod and lever arm arrangement can produce an unacceptable noise problem as the bearings wear. Furthermore, arrangements such as Imhoff do not entirely eliminate the vagrant motion of the bellows since the rotation of the cam wheel and the resultant pivotal motion of the drive rod may introduce a horizontal component in the drive force supplied to the bellows. In addition, the drive mechanism for Imhoff is large and must be mounted beside the air pressure regulator, thus requiring an excessive amount of space in an area where space is usually at a premium, for most organ installations are located in crowded quarters.

SUMMARY OF THE INVENTION

The present invention overcomes the difficulties of the prior art as outlined above by the provision of an improved tremolo generator which consists of an elongated housing pivotally secured at one end and having a free end adapted for reciprocating motion. The first end of the housing carries a drive motor and the free end carries a shaft on which is mounted a counterweight, the shaft being driven by a suitable belt drive extending from the electric motor. Intermediate the ends of the elongated housing is a link which connects the housing to the center of a bellows for a pipe organ air pressure regulator whereby motion of the tremolo generator housing is transferred to the bellows as a linear motion of the connecting link. By locating the electric motor at the fixed end of the housing, the main weight of the tremolo device is removed from the bellows so that the device of the present invention does not have a substantial effect on the resonant characteristic of the bellows. Because one end of the housing is fixed, the motion of the connecting link is constrained to a substantially linear path, thus preventing the destructive side-to-side motion of the bellows that resulted from prior arrangements. The use of a driven eccentric weight arrangement allows accurate adjustment of the amplitude of the tremolo effect, while the direct mounting of the device adjacent the bellows eliminates unnecessary linkages, reduces noise, and increases the efficiency of the device. In addition, the use of an eccentric weight mounted on a driven shaft provides an improved ratio of the motion of the weight with respect to the motion of the bellows than was previously available, and thus further improves the efficiency of the device. All of these features combine to provide a tremolo generator which produces a clean, easily controlled tremolo effect throughout the dynamic range of the organ.

BRIEF DESCRIPTION OF THE DRAWINGS

The foregoing and additional objects, features and advantages of the present invention will become apparent from a more detailed consideration thereof, taken in conjunction with the accompanying drawings, in which.

DESCRIPTION OF PREFERRED EMBODIMENTS

Figure 1:
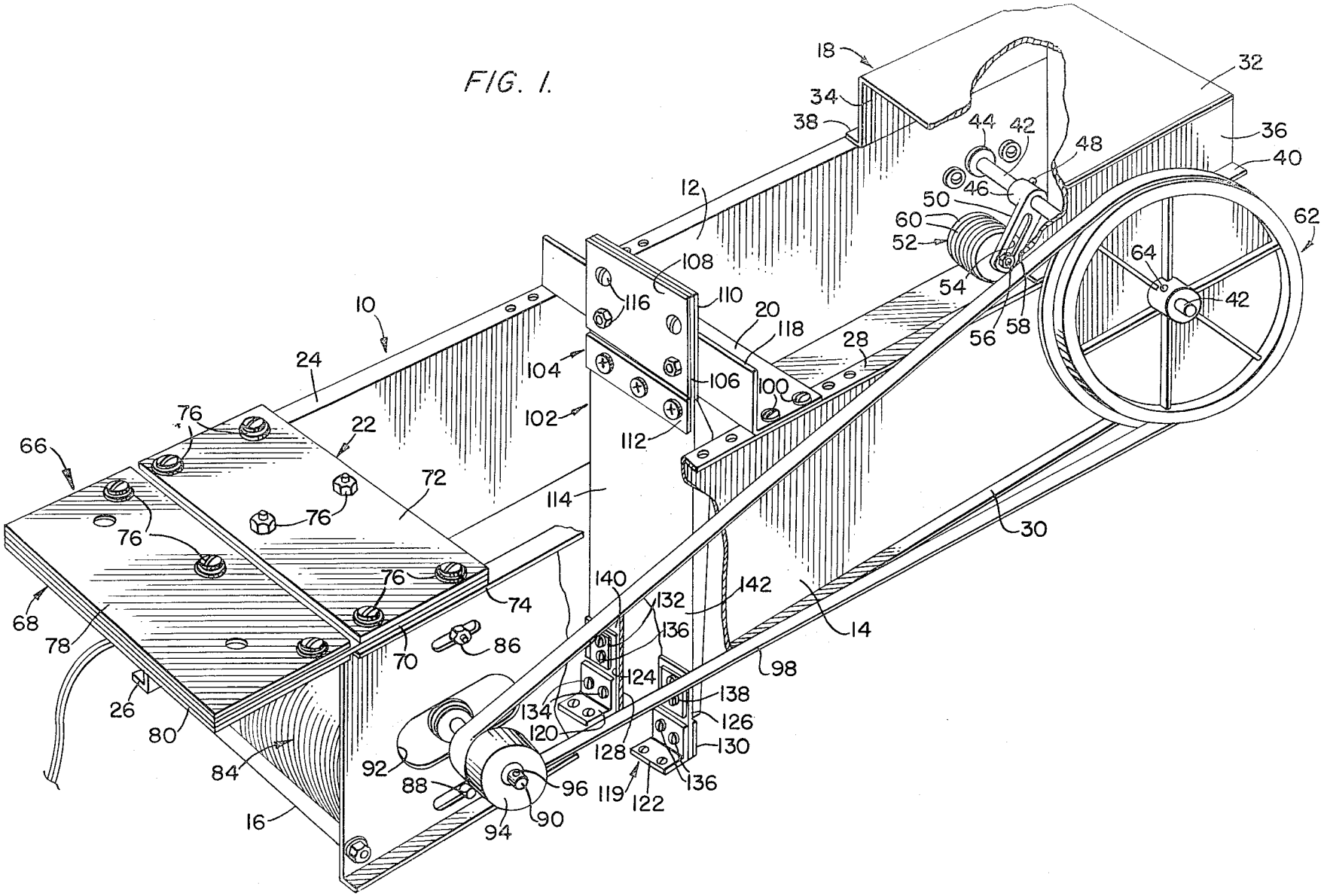
FIG. 1 is a perspective view of the electrically-driven tremolo device of the present invention.
Figure 2:
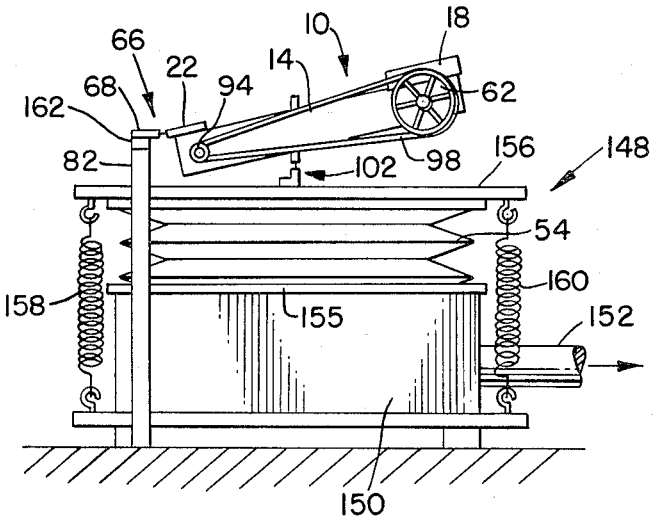
FIG. 2 is a side elevation view of a typical air pressure regulator with the tremolo device of FIG. 1 mounted thereon.

Turning now to a more detailed consideration of the present invention, there is illustrated in FIGS. 1 and 2 a tremolo generator 10 constructed in accordance with the present invention. The generator includes a housing formed from first and second side rails 12 and 14 which are secured in spaced apart relationship by suitable braces 16, a partial cover 18 and cross brackets 20 and 22. The side rails 12 and 14 may take a variety of forms, but in the preferred embodiment illustrated herein they are in the form of sheet metal walls having upper and lower outwardly extending flanges 24 and 26, and 28 and 30, respectively.

The housing cover 18 may extend the full length of the tremolo generator 10, but in the preferred form covers only the end of the device which receives the rotating eccentric weights (to be described) so as to prevent injury when the generator is in operation. The housing cover 18 may include a top wall 32 and side walls 34 and 36, the side walls including outwardly turned flanges 38 and 40, respectively, by which the cover 18 is secured to the side rails 12 and 14 as by suitable nuts and bolts or other fasteners (not shown).

A support shaft 42 extends between the side rails 12 and 14 and is journaled therein by suitable support bearings 44 for rotation. The shaft carries, within the space between the side rails 12 and 14, a bracket 46 which is secured to the shaft for rotation therewith by means of a suitable key arrangement, a set screw 48, or by other suitable means. The bracket includes an arm portion 50 which is adapted to support a weight 52 at a predetermined and adjustable distance from the axis of the shaft 42 so that the weight is eccentrically mounted with respect to its axis of rotation. Adjustability of the position of the weight may be accomplished by providing arm 15 with an elongated slot 54 through which a threaded support bolt 56 may extend, whereby the weight may be fastened to the bracket by a suitable washer and nut 58 or other fastener.

The weight 52 may comprise a plurality of discs 60 mounted on the threaded bolt 56. The discs are removable so that the number of discs can be varied to provide the desired weight, with the mounting slot 54 permitting adjustment of the length of the moment arm between the axis of the weight 52, this moment arm being the distance between the axis of bolt 56 and the axis of shaft 42.

Support shaft 42 extends through its journal bearing (not shown) in rail 14 and receives a drive pulley 62 which may be secured to the outer end of the support shaft by any suitable means such as set screw 64.

The shaft 42, the eccentrically mounted weight 52 and the pulley 62 are mounted at what may be termed the fre or distal end of the tremolo generator housing. The opposite, or fixed, end of the housing incorporates the cross bracket 22 which forms a part of the mounting assembly, generally indicated at 66, for the generator device. In the preferred embodiment illustrated herein, the mounting assembly consists essentially of a pair of hinged brackets, one of which is the cross bracket 22 and the other of which is a mounting bracket 68. These two brackets are secured together by a flexible sheet 70 which allows the mounting assembly to flex in a hinge-like manner but which provides a secure mounting for the tremolo generator. The sheet 70 may be any suitable material such as fabric-reinforced rubber which can withstand flexing while supporting the weight of the generator.

The cross bracket 22 is constructed of upper and lower parallel plates 72 and 74 between which is secured one end of the hinged sheet 70. The upper and lower plates 72 and 74 are clamped together and secured to the upper flanges 24 and 28 of side rails 12 and 14 by means of suitable fasteners 76. In similar manner the mounting bracket 68 is comprised of upper and lower parallel plates 78 and 80 which receive and clamp the other end of hinge sheet 70, the portion 68 serving also as a mounting plate for securing the generator to a suitable support bracket such as that illustrated at 82 in FIG. 2.

An electric drive motor 84 is mounted between side rails 12 and 14 at the fixed end of generator 10 as by suitable fasteners 86 and 88. The motor is a conventional single speed or variable speed motor which may be in the range of 1/50 to 1/10 HP for typical church organ use, and larger for theater organs. If a variable speed motor is used, it may be controlled either at the tremolo generator remote location such as the console of an organ with with the tremolo device is associated. The drive shaft 90 of the electric motor extends through a suitable opening 92 in side rail 14 and receives a drive pulley 94 which may be secured to the shaft 90, as by a set screw 96. A conventional drive belt 98 extends between drive pulley 94 and driven pulley 62 whereby rotation of the electric motor drives support shaft 42 to rotate bracket 50 and eccentric weight 52.

Cross bracket 20 extends between side rails 12 and 14 and is secured to the upper flanges 24 and 28 thereof by suitable fasteners 100. The flanges 24 and 28 include a plurality of holes for receiving fasteners 100 to permit longitudinal adjustment of the cross bracket with respect to the side rails and thus to permit variation in the distance between bracket 20 and the support shaft 42.

The bracket 20 serves to support a linking assembly, generally indicated at 102, which connects the tremolo generator to the bellows of an air reservoir. Although the linking assembly 102 may take numerous forms, in a preferred embodiment it includes an upper hinge assembly 104 which is generally similar to the mounting assembly 66 as described above in that it includes a hinge sheet 106 of flexible material secured at one end between a pair of upper mounting plates 108 and 110 and at a lower end between a lower plate 112 and a drive arm 114. The hinge sheet 106 is clamped between plates 108 and 110 by suitable fasteners 116 which also serve to secure the upper hinge assembly 104 to the cross brace 20. In the preferred form illustrated, the cross brace is generally L-shaped with an upstanding flange 118 receiving fasteners 116 to secure the link arm 102 to the tremolo generator. As illustrated, the upper mounting plates 108 and 110 are spaced from the lower plate 112 and the drive arm 114 to permit free flexing of sheet 106 but are sufficiently close together to insure that the sheet will not buckle but will transfer the motion of tremolo generator 10 through the linking arm 102 to the bellows of the air pressure regulator (to be described).

The lower end of the drive arm 114 carries a suitable bracket assembly 119 for securing the generator 10 to the air pressure regulator. As illustrated, assembly 119 may include a pair of L-shaped brackets 120 and 122 each secured to a corresponding hinge sheet 124 and 126 by suitable mounting plates 128 and 130, respectively, the brackets being secured to the corresponding mounting plates and clamping the corresponding hinge sheets therebetween by means of fasteners 134 and 136, respectively. The hinge sheets are similarly clamped to the lower end of the drive arm 114 by suitable mounting plates 132 and 134 and fasteners 136 and 138, respectively. Although the drive arm 114 is shown as being bifurcated at its lower end to form a pair of parallel legs 140 and 142 which support the brackets 120 and 122, respectively, it will be apparent that this arrangement is a preferred form, and that other interconnections between the drive arm 114 and the bellows may be provided.

Referring now to FIG. 2, there is illustrated in diagrammatic form the manner in which the tremolo generator 10 may be mounted adjacent the bellows portion of an air pressure regulator 148 for a pipe organ. The regulator 148 includes a reservoir, or air chamber 150, which receives air by way of a suitable conduit (not shown) from a source of supply such as a conventional centrifugal or fan type blower. The reservoir 150 is an enclosed, air-tight chamber mounted in a convenient location with respect to the conventional wind chest which supplies air directly to the organ pipes, and is connected to the wind chest by means of a conduit 152. Mounted on top of the reservoir and covering either the entire reservoir or a part thereof, is a bellows 154 which usually has a generally rectangular cross-section. The bottom edge 155 of the bellows is secured to a top wall 156, with the interior of the bellows being open to the reservoir. The top wall 156 is connected by a suitable linkage (not shown) to a rectangular valve (also not shown) which is conventionally located in the air flow path between the blower and conduit 152. Motion of the bellows opens and closes the valve proportionally, so as to regulate the flow of air to the organ wind chest, and thus to regulate the pressure of the air supplied to the organ pipes. The top of the bellows is biased downwardly to close the bellows either by means of coil springs such as those illustrated at 158 and 160, by means of suitable weights (not shown) mounted on the top wall 156, or by a combination thereof. Although only two springs 158 and 160 are illustrated, it will be understood that usually four springs will be provided, one at each corner of the bellows, to provide an even distribution of the biasing force. The biasing elements tend to pull the bellows downwardly to the closed position, but when air is supplied under pressure to the reservoir, the bellows is inflated to move the top wall upwardly to a position of equilibrium between the pressure exerted by the biasing elements. When air is drawn from the reservoir by way of conduit 152, as when the organ pipes are activated, the pressure in the reservoir tends to drop, since the blower supplying air to the system normally cannot respond to rapid transient pressure changes. However, the bellows is capable of responding rapidly to a drop in pressure, and when this occurs, the biasing means collapses the bellows by an amount necessary to compensate for the change in air volume, opens the regulator valve to increase the air flow to maintain the pressure within the air supply system at the organ. Thus, in normal operation the air pressure regulator responds rapidly to demands for air to be delivered to the wind chest and organ pipes, thus preventing undesired variations in the speech of the organ pipes.

The tremolo generator of the present invention provides a mechanism for superimposing on the normal pressure-regulating motion of the bellows pulsating or periodic variations in the motion of the bellows, and thus in the air pressure supplied to the organ pipes, to thereby produce corresponding variations in the speech of the pipes and thus to produce the desired tremolo effects. To accomplish this, the tremolo generator is secured to a suitable fixed bracket assembly such as that illustrated at 82 which straddles the regulator and bellows assembly and, in the illustrated form, provides a horizontal bar 162 extending across and generally parallel to the upper wall 156 of the bellows. The bar 162 is spaced from the bellows sufficiently to allow free motion of the bellows and is adapted to receive the mounting bracket portion 68 of the hinge assembly 66 of the tremolo generator. Bracket 82 is at one side of the regulator so that the generator 10 can be mounted by means of hinge assembly 66 at a location spaced above and generally parallel to the horizontal upper wall 156 of the bellows. The generator 10 preferrably extends over the center point of wall 156 so that the linking arm 102 may be secured at the approximate center point of the bellows.

The hinge assembly 66 allows the tremolo generator 10 to pivot with respect to the bracket assembly 82 so that the free end of the generator 10 moves in a direction generally perpendicular to the plane of wall 156. The tremolo generator is secured through linking arm 102 to the center of wall 156 by means of the bracket assembly 119 so that vertical motion of wall 156 results in pivotal motion of the generator about the hinge assembly 66, and vice versa. In normal operation of the air regulator, vertical motion of the bellows 154 in response to changes in the air flow out of conduit 152 results in pivotal motion of the tremolo generator. Although the generator assembly introduced added weight to the wall 156, this weight is equivalent to a biasing weight and may be compensated by removal of auxiliary weights from the upper wall, by changes in the spring tension, or the like. It should be noted, however, that since the electric motor 84 is mounted very close to the hinge assembly 66, and in fact in the preferred form is located under the cross brace 22, the major weight of the motor, and thus of the tremolo assembly, is supported by the hinge assembly and does not appreciably affect the operation of the bellows.

When it is desired to produce a tremolo effect, the electric motor 84 is energized to rotate drive shaft 90 and, by means of belt 98, the pulley 62 and the support shaft 42. Rotation of shaft 42 causes the eccentrically mounted weight 52 to swing around the axis of the shaft, producing periodically varying forces on the side rails 12 and 14 of the generator housing. Because the hinge assembly 66 prevents longitudinal motion of the rails, but allows transverse motion with respect to the longitudinal axis of the housing, the transverse component of the forces produced by the rotating weights cause the generator housing to pivot alternately clockwise and counterclockwise about the hinge connection 66. This pivotal, or oscillatory motion of the generator 10 is transmitted by way of the linking arm 102 to the upper wall 156 of the bellows to produce a periodic reciprocating motion in the bellows at a rate which corresponds to the speed of rotation of shaft 42 and with an amplitude which corresponds to the mass of weight 52 and the length of its moment arm with respect to the axis of shaft 42. This reciprocating motion is superimposed on any movement of the bellows in response to air demands from the organ, and produces a corresponding variation in the air pressure delivered by conduit 152 to the organ pipes, resulting in the desired tremolo effects.

Figure 3:
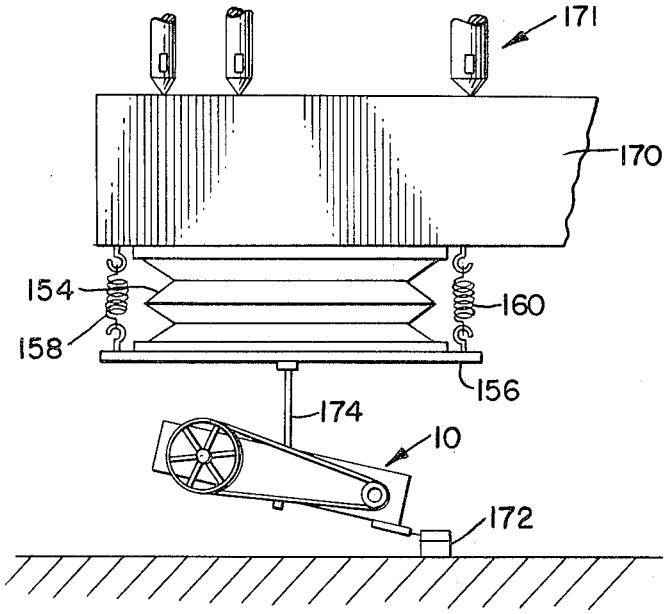
FIG. 3 is a side elevation of a modified form of air regulator with a modified version of the tremolo device of FIG. 1 secured thereto.

Although the tremolo generator is shown in its preferred form as being mounted over the bellows of a conventional air pressure regulator and connected thereto by a relatively rigid link assembly 102, it will be apparent that numerous variations can be made to accomodate the generator 10 to different bellows arrangements. Thus, for example, FIG. 3 illustrates how the tremolo generator 10 may be adapted for use with an inverted reservoir arrangement for pipe organs, wherein the wind chest itself acts as a part of the air reservoir, thereby eliminating the need for a separately located bellows. Thus, in such an arrangement the bellows 154 may be mounted directly to a wind chest 170, with the bellows being biased toward its closed position by means of a suitable springs 158 and 160 as before. However, in the inverted arrangement, the bellows is located on the bottom of the wind chest, since the organ pipes generally indicated at 171, are mounted on the top thereof, so that the tremolo generator cannot be mounted in the manner described with respect to FIG. 2. In this system, however, the generator 10 may be mounted in a generally horizontal position below the bellows, as by means of a fixed mounting block 172, and connected to the bellows by means of a modified linking arrangement which in this embodiment may be a rod or cable 174. If the generator 10 cannot be mounted directly below the bellows, the cable may be connected by way of one or more pulleys to provide the required periodic vertical force on the bellows. Again, although the weight of the tremolo generator will tend to affect the bias of the bellows, this can be compensated by suitable adjustment of the bias springs 158 and 160. Various other linking arrangements may be made to accomodate the tremolo generator of the invention to other air pressure regulator systems, or to separate bellows arrangements specifically used for tremolo production.

Figure 4:
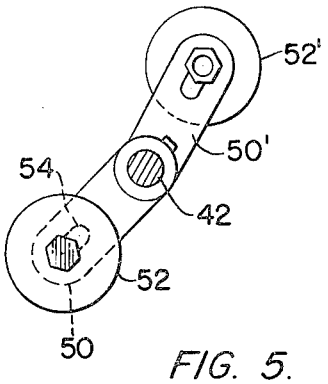
FIG. 4 is a side elevation in partial section of a modified form of eccentric weight for the device of FIG. 1.
Figure 5:
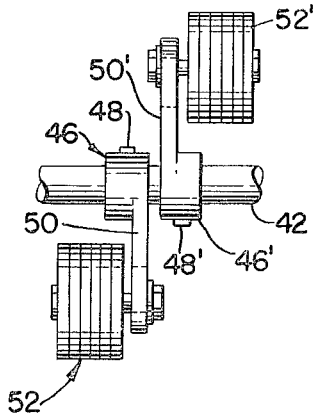
FIG. 5 is a side view of the device of FIG. 4.

Although the single eccentrically mounted weight of FIG. 1 provides satisfactory operation, additional adjustments in the tremolo effect may be provided through the use of two eccentric weights mounted on shaft 42 and angularly adjustable to each other. This arrangement is illustrated in FIGS. 4 and 5, where, in addition to bracket 46 and its associated weight 52, there is also provided a second bracket 46' and an associated weight 52'. These two brackets may be angularly adjusted with respect to each other about shaft 42 and secured by corresponding set screws 48 and 48', the angular setting of these weights allowing variations in the amplitude of the motion produced by the tremolo generator and varying the depth of the motion of the bellows, without the need for adding or subtracting weights.

Thus there has been described an improved tremolo generator device which may be utilized with any existing air regulator for a pipe organ to provide reliable, easily adjustable tremolo effects which are constant throughout the dynamic range of the organ and which does not adversely affect the operation of the air pressure regulator. The device is lightweight and simple to construct, yet is rugged and reliable and does not require constant maintenance. Further, because of the nature of the hinge arrangement provided, the generator is exceptionally quiet, the flexible hinges dampening any motor vibration so that it is not transmitted either to the mounting bracket or to the structure of the air pressure regulator. By using flexible reinforced sheet material, exceptionally long-wearing, low maintenance and low noise connections are obtained and, if any of the hinges should show signs of wear, they are easily replaceable by simply unbolting the fastening plates.

Although numerous variations and modifications to the invention are described above will be evident to those of skill in the art, such variations are within the true spirit and scope of the present invention as defined in the following claims.

I claim:

1. A tremolo generator for connection to an air supply enclosure of a pipe organ, comprising;

an elongated housing having a fixed end and a free end;

eccentric weight means rotatably mounted at the free end of said housing;

a drive motor mounted on said housing for rotating said eccentric weight means; and linking means intermediate said fixed and free ends and connecting said housing to the air supply enclosure of a pipe organ for transmitting motion of said housing due to rotation of said weight to the air supply enclosure to produce periodic tremulant variations in the pressure of the air supplied to the pipe organ.

2. The tremolo generator of claim 1, wherein said drive motor is mounted at the fixed end of said housing.

3. The tremolo generator of claim 1, further including means for selectively varying the speed of rotation of said eccentric weight means, whereby the frequency of said periodic tremulant variations may be selected.

4. The tremolo generator of claim 1, further including means for varying the weight and moment arm of said eccentric weight, whereby the amplitude of said periodic tremulant variations may be selected.

5. The tremolo generator of claim 1, further including means for adjustably locating said linking means intermediate said fixed and free ends of said housing, whereby the amount of motion transmitted from said housing to the air supply enclosure may be selected.

6. The tremolo generator of claim 1, wherein said linking means comprises a drive arm and connecting means for a drive arm and connecting means for securing said drive arm between said housing and the air supply enclosure, said connecting means being flexible to reduce the transmission of noise and vibration to said enclosure.

7. The tremolo generator of claim 1, further including a mounting assembly at the fixed end of said housing, said mounting assembly including flexible means for pivotally securing said fixed end, whereby said free end of said housing can oscillate about said mounting assembly.

8. The tremolo generator of claim 1, wherein said linking means comprises cable means.

9. An electrically driven tremolo device for producing periodic reciprocation motion and for transmitting such motion to an air reservoir for a pipe organ air supply, comprising:

an elongated housing;

a mounting assembly at a first end of said housing, said mounting assembly including means for securing said housing for pivotal motion about said first end thereof;

eccentric weight means;

means for rotatably mounting said eccentric weight means at a second end of said housing, whereby rotation of said eccentric weight means causes said housing to pivot about said first end thereof to produce an oscillatory motion of said second end;

linking means secured at a location intermediate said first and second ends of said housing, whereby oscillatory motion of said housing produces substantially linear reciprocating motion of said linking means in a direction transverst to the longitudinal axis of said housing;

means for securing said linking means to an air reservoir for a pipe organ; and drive means for rotating said eccentric weight means to oscillate said housing and to produce in said air reservoir corresponding changes in air pressure to provide a tremolo effect in the pipe organ.

10. The tremolo device of claim 9, wherein said drive means includes motor means mounted at the first end of said housing.

11. The tremolo device of claim 9, wherein said drive means further includes belt means connected between said drive motor and said means for rotatably mounting said eccentric weight.

12. The tremolo device of claim 10, wherein said eccentric weight comprises at least one weight mounted on and offset from a rotatable support shaft the distance between the axes of said weight and said shaft defining the moment arm of said weight.

13. The tremolo device of claim 12, wherein said moment arm is selectively variable.

14. The tremolo device of claim 13, wherein said weight is variable.

15. The tremolo device of claim 12, wherein said mounting assembly is adapted to secure said housing substantially parallel to a movable wall of an air reservoir, said linking means being secured to said reservoir so that reciprocating motion of said linking means moves said movable wall and correspondingly varies the capacity of said reservoir.

* * * * *

UNITED STATES PATENT AND TRADEMARK OFFICE

CERTIFICATE OF CORRECTION

PATENT NO. : 4,319,513

DATED : March 16, 1982

INVENTOR(S) : RICHARD H. PETERSON

It is certified that error appears in the above-identified patent and that said Letters Patent are hereby corrected as shown below:

Claim 9, line 18, change "transverst" to --transverse--.

Claim 11, line 1, change "9" to --10--.

Signed and Sealed this

*First* Day of *June 1982*

[SEAL]

*Attest:*

GERALD J. MOSSINGHOFF

*Attesting Officer*

*Commissioner of Patents and Trademarks*